US006589297B2

(12) United States Patent
Mach et al.

(10) Patent No.: US 6,589,297 B2
(45) Date of Patent: Jul. 8, 2003

(54) TEXTILE SPUN-DYED FIBER MATERIAL AND USE THEREOF FOR PRODUCING CAMOUFLAGE ARTICLES

(75) Inventors: Horst Roland Mach, Glashütten (DE); Guido Krabbe, Eppstein-Ehlhalten (DE)

(73) Assignee: Dystar Textilfarben GmbH & Co Deutschland KG (DE)

( * ) Notice: Subject to any disclaimer, the term of this patent is extended or adjusted under 35 U.S.C. 154(b) by 51 days.

(21) Appl. No.: 09/741,709

(22) Filed: Dec. 20, 2000

(65) Prior Publication Data

US 2001/0004780 A1 Jun. 28, 2001

(30) Foreign Application Priority Data

Dec. 23, 1999 (DE) ..... 199 62 916

(51) Int. Cl.[7] ..... D06P 3/00

(52) U.S. Cl. ..... 8/638; 8/529; 8/532; 8/650; 8/478; 8/518

(58) Field of Search ..... 8/529, 532, 938, 8/650, 603, 478, 512, 518, 638; 442/289; 428/90

(56) References Cited

U.S. PATENT DOCUMENTS

| | | | | |
|---|---|---|---|---|
| 4,095,940 A | | 6/1978 | Weingarten | 8/483 |
| 4,831,068 A | | 5/1989 | Reiner et al. | 524/100 |
| 5,607,483 A | * | 3/1997 | Burkinshaw et al. | 8/650 |
| 5,798,304 A | * | 8/1998 | Clarkson | 442/289 |
| 5,863,633 A | * | 1/1999 | Squires et al. | 428/90 |
| 5,873,914 A | * | 2/1999 | Burkinshaw et al. | 8/650 |

FOREIGN PATENT DOCUMENTS

| | | |
|---|---|---|
| DE | 22 00 323 | 6/1978 |
| EP | 0 091 785 | 10/1983 |

* cited by examiner

*Primary Examiner*—Gregory Delcotto
*Assistant Examiner*—Eisa Elhilo
(74) *Attorney, Agent, or Firm*—Connolly Bove Lodge & Hutz LLP

(57) ABSTRACT

The present invention relates to textile spun-dyed fiber material comprising synthetic fibers or mixtures of cellulosic and synthetic fibers for producing military camouflage articles, wherein the synthetic fiber fraction is spun-dyed with a dye having a chlorophyll-like reflectance in the IR region, and to its use for producing military camouflage print articles.

9 Claims, No Drawings

TEXTILE SPUN-DYED FIBER MATERIAL AND USE THEREOF FOR PRODUCING CAMOUFLAGE ARTICLES

The present invention relates to a textile spun-dyed fiber material comprising synthetic fibers or mixtures of cellulosic and synthetic fibers where the synthetic fiber fraction has been dyed and to its use for producing camouflage articles.

Textile materials for the military sector are typically made of synthetic fibers, for example polyester or polyamide, or of mixtures of cellulosic and synthetic fibers. With regard to an adequate camouflaging effect, it is mainly in the hue regions of light green, grayish green, olive and dark green that reflectance characteristics are sought in the near infrared region which resemble those of natural leaf green, ie. chlorophyll. At the same time, a high fastness level is stipulated, especially with regard to lightfastness, chlorine fastness, crockfastness, washfastness and scuff fastness.

Meeting the requirements mentioned has presented appreciable problems in the past. In the case of fiber blends for instance different substrate-specific dye classes are to be used not only in textile printing but also in dyeing. As well as the choice of suitable dyes, which must not adversely affect each other in their IR reflectance properties or in their application properties, being complicated, separate fixing processes are always needed for each class of dye. It is also known that it is particularly difficult to dye straight polyamide textiles level in conventional dyeing processes. Prior art processes are thus costly and time-consuming.

There is an urgent need for improved economical processes which, moreover, shall also be consistent and ecologically advantageous.

It has now been surprisingly found that the problems mentioned are solved by having a spun-dyed fiber material wherein the synthetic fiber fraction has been dyed with a dye which has the required IR reflectance properties subsequently cross-printed or -dyed, this second step only printing or dyeing the cellulose fraction in the case of cellulose blend substrates.

The printing or dyeing of blend fabrics thus no longer requires the use of two classes of dye and distinct fixing processes, since the synthetic fiber fraction has already been covered by the spin dyeing and also already incorporates the chlorophyll-like IR reflectance.

The present invention accordingly provides a textile spun-dyed fiber material comprising synthetic fibers or mixtures of cellulosic and synthetic fibers for producing military camouflage articles, wherein the synthetic fiber fraction is spun-dyed with a dye having a chlorophyll-like reflectance in the IR region.

The present invention also provides for the use of textile spun-dyed fiber material comprising synthetic fibers for producing military camouflage print articles, which comprises camouflage patterns being printed on in a conventional manner.

The present invention further provides for the use of textile spun-dyed fiber material comprising mixtures of cellulosic and synthetic fibers for producing military camouflage articles, which comprises the cellulose fraction being dyed or printed with camouflage patterns.

The textile spun-dyed fiber materials of the invention are in particular fabrics and can be made of straight synthetic fibers, especially polyester or polyamide. But preferably they are blend fabrics with cellulose, particular preference being given to cellulose-polyester blend fabrics.

With regard to the end use, the synthetic fiber fraction of the textile spun-dyed fiber materials of the invention is typically spun-dyed in a medium gray, green or olive hue. Useful dyes include in principle all dyes which are suitable for spin dyeing and which have the necessary chlorophyll-like reflectance in the IR region. These dyes can be used alone or mixed with each other. To obtain the desired basic hues, they can further be combined with further colorants useful in spin dyeing. However, care must always be taken to ensure that the IR reflectance characteristics of the end product do not have an adverse effect on the chlorophyll-typical curve. Provided this prerequisite is met, the mixing ratios of the individual dyes or colorants used are not critical and are only determined by the desired basic hue.

Preferred dyes useful for spin dyeing the synthetic fiber fraction include for example C.I. Solvent Blue 122, C.I. Solvent Blue 132, C.I. Solvent Blue 104, C.I. Solvent Blue 45, C.I. Solvent Yellow 83, C.I. Solvent Yellow 147, C.I. Solvent Brown 53, C.I. Disperse Violet 57 and C.I. Pigment Blue 29.

The spin dyeing process is known per se. In spin dyeing, the spinning solution or melt is admixed with pigment or soluble dyes which remain in the fiber at the coagulation stage and thus color the fiber. The colorants are preferably added in the form of masterbatches which may already contain any assistants required. Details concerning spin dyeing may be found in Römpp Chemielexikon, $9^{th}$ edition, 1992, volume 5, page 4247, and especially the references cited therein. Inventive textile spun-dyed material consisting exclusively of synthetic fibers is also useful as such for camouflage articles when a solid color is acceptable. In this case the desired hue is obtained exclusively by spin dyeing using appropriate amounts of dye.

Generally, however, the inventive textile spun-dyed fiber material consisting exclusively of synthetic fibers is used for producing military camouflage print articles. To this end, the desired camouflage patterns are printed on in the corresponding camouflage hues in a second step. This step may in principle employ the same dyes as already used in spin dyeing. Generally, disperse dyes are used for polyester fibers and acid or metal complex dyes for polyamide fibers. It is advantageous in this case to produce the spin dyeing in that shade which corresponds to the lightest hue of the camouflage print pattern and to print on the darker patterns. The lightest hue is generally light green.

When the inventive textile spun-dyed fiber material comprises a mixture of cellulosic and synthetic fibers, it can be used for producing military camouflage articles by exclusively dyeing or printing the cellulose fraction in a second operation. If a single-colored end product is to be obtained, the spun-dyed product is cross-dyed with a dye suitable for cellulosic fibers. It is advantageous here for the hue produced by the spin dyeing to be very close to the final hue.

Generally, however, the inventive textile spun-dyed fiber materials comprising a mixture of cellulosic and synthetic fibers are printed with camouflage patterns in a second operation, again using dyes suitable for cellulose. It is preferable in this case for the spin dyeing to be carried out in a medium gray, green or olive hue and the subsequent printing to be carried out with typical camouflage print hues such as black, brown and various olive or green shades. The medium shades of the spin dyeing are blotted out by the deeper overprinted shades and do not adversely affect the overall appearance of the finished product.

Useful dyes for dyeing or printing the cellulose fraction are all dyes suitable for cellulose, although care must be taken to ensure that their IR reflectance curve is similar to that of chlorophyll or at least does not excessively affect the reflectance curve of the dye used in spin dyeing. In one version of the present invention, however, it is also possible to print with an extremely low reflectance black dye which completely eliminates the chlorophyll-like reflectance curve. In this case, the IR reflectance values correspond to those of natural soil, so that their use for camouflaging purposes is advantageous here too. The dyes useful for dyeing and printing the cellulose fraction can likewise be used alone or mixed with each other in wide mixing ratios.

Preferred dyes for cellulose are in particular vat dyes and sulfur dyes. Particularly useful dyes are C.I. Vat Yellow 4, C.I. Vat Yellow 33, C.I. Vat Orange 1, C.I. Vat Orange 7, C.I. Vat Orange 11, C.I. Vat Orange 15, C.I. Vat Blue 5, C.I. Vat Blue 19, C.I. Vat Blue 66, C.I. Vat Green 1, C.I. Vat Green 3, C.I. Vat Green 9, C.I. Vat Green 13, C.I. Vat Brown 1, C.I. Vat Brown 3, C.I. Vat Brown 57, C.I. Vat Black 7, C.I. Vat Black 8, C.I. Vat Black 9, C.I. Vat Black 19, C.I. Vat Black 25, C.I. Vat Black 27, C.I. Sulfur Black 1, C.I. Sulfur Black 6 and C.I. Sulfur Black 7.

The cellulose fraction of the textile spun-dyed fiber material of the invention can be dyed and printed according to conventional methods for applying the various classes of dye, for example as described in H. Rath, Lehrbuch der Textilchemie, Springer Verlag, Berlin, Heidelberg, N.Y., $3^{rd}$ edition 1972, especially pages 557–568, 571–575, 678.683 and 703–704 or in M. Peter and H. K. Rouette, Grundlagen der Textilveredlung, Deutscher Fachverlag, $13^{th}$ revised edition, 1989, especially pages 500–509 and 624–625.

EXAMPLE 1

(a) A PES spin dyeing masterbatch consisting of 25% C.I. Solvent Blue 122, 50% C.I. Solvent Yellow 147 and 25% PBT carrier is used in a concentration of 2.5% as spin dyeing in PES fiber production. The linear density of the fiber is 1.6 dtex. This provides an olive green PES fiber which is blended with cotton fibers in a ratio of 50:50, spun and made into a textile sheet material by weaving or else knitting or nonwoven technology.

(b) The textile material produced according to (a) is printed with camouflage shades using a print paste of the following composition.

| | |
|---|---|
| 20.0 | g/kg of C.I. Vat Yellow 04 |
| 1.9 | g/kg of C.I. Vat Orange 07 |
| 6.1 | g/kg of C.I. Vat Blue 66 |
| 700.0 | g/kg of thickening for 2-step fixation |
| 272.0 | g/kg balance (water of thickening) |
| 1000.00 | g |

The customary 2-step fixation for vat dyes provides a light green hue having IR reflectance values which are very close to those of natural chlorophyll.

EXAMPLE 2

The textile material produced according to Example 1a) is printed with camouflage shades using a print paste of the following composition.

| | |
|---|---|
| 13.0 | g/kg of C.I. Vat Orange 01 |
| 16.0 | g/kg of C.I. Vat Blue 66 |
| 10.0 | g/kg of C.I. Vat Black 27 |

-continued

| | |
|---|---|
| 700.0 | g/kg of thickening for 2-step fixation |
| 261.0 | g/kg balance (water of thickening) |
| 1000.00 | g |

The customary 2-step fixation for vat dyes provides a dark green hue having IR reflectance values which are very close to those of natural chlorophyll in the dark green region.

EXAMPLE 3

The textile material produced according to Example 1a) is cross-dyed with the vat dyes mentioned in Example 2 in a continuous dyeing process.

EXAMPLE 4

The textile material produced according to Example 1a) is printed with camouflage shades using a print paste of the following composition.

| | |
|---|---|
| 100.0 | g/kg of C.I. Sulphur Black 06 |
| 700.0 | g/kg of thickening for 2-step fixation |
| 200.0 | g/kg balance (water of thickening) |
| 1000.00 | g |

The customary 2-step fixation for vat dyes provides a black shade having IR reflectance values which are between 3.0% (600 nm) and 10.0% (1300 nm) and correspond to those of natural soil.

The original, chlorophyll-like reflectance curve of the spun-dyed polyester fiber fraction is completely eliminated by the extremely low reflectance black dye.

EXAMPLE 5

The textile material produced according to Example 1a) is cross-dyed with the sulfur dye mentioned in Example 4 in a continuous dyeing process.

EXAMPLE 6

A PA spin dyeing masterbatch consisting of 40% C.I. Solvent Blue 132, 40% C.I. Solvent Yellow 83 and 20% PA carrier is used in a concentration of 2.5% as spin dyeing in PA (nylon-6 or nylon-6,6) fiber production.

This provides an olive green polyamide fiber which is spun and converted into a textile sheet material by weaving, knitting or nonwoven technology. The sheet material has uniform color and can subsequently be printed in conventional manner with dye classes typical for polyamide fibers, such as acid, metal complex or reactive dyes.

EXAMPLE 7

The polyamide fibers obtained as per Example 6 are blended with cotton fibers in a ratio of 50:50 and converted into a textile sheet material as described. This material is printed with camouflage shades similarly to Examples 1b, 2 or 4.

What is claimed is:

1. Textile spun-dyed fiber material comprising synthetic fibers or mixtures of cellulosic and synthetic fibers for producing military camouflage articles, wherein the synthetic fiber fraction is spun-dyed with a dye having a chlorophyll-like reflectance in the IR region.

2. The textile spun-dyed fiber material of claim 1, wherein the synthetic fiber fraction is spun-dyed with C.I. Solvent Blue 122, C.I. Solvent Blue 132, C.I. Solvent Blue 104, C.I. Solvent Blue 45, C.I. Solvent Yellow 147, C.I. Solvent Yellow 83, C.I. Solvent Brown 53, C.I. Disperse Violet 57 or C.I. Pigment Blue 29.

3. The textile spun-dyed material of claim 1, comprising cellulose-polyester blend fabric.

4. A method of using a textile spun-dyed fiber material comprising synthetic fibers as set forth in claim 1 comprising the steps of producing military camouflage print articles by printing camouflage patterns on the material.

5. A method of using a textile spun-dyed fiber material comprising mixtures of cellulosic and synthetic fibers as set forth in claim 1 comprising the steps of producing military camouflage articles by printing or dying the cellulose fraction with camouflage patterns.

6. The method of claim 5, wherein a textile fiber material spun-dyed in medium gray, green or olive shades is cross-printed with camouflage patterns in black, brown, olive or green shades.

7. The method of claim 5, wherein the cellulose fraction is dyed or printed with vat or sulfur dyes.

8. The method of claim 7, wherein the vat dyes used are C.I. Vat Yellow 4, C.I. Vat Yellow 33, C.I. Vat Orange 1, C.I. Vat Orange 7, C.I. Vat Orange 11, C.I. Vat Orange 15, C.I. Vat Blue 5, C.I. Vat Blue 19, C.I. Vat Blue 66, C.I. Vat Green 1, C.I. Vat Green 3, C.I. Vat Green 9, C.I. Vat Green 13, C.I. Vat Brown 1, C.I. Vat Brown 3, C.I. Vat Brown 57, C.I. Vat Black 7, C.I. Vat Black 8, C.I. Vat Black 9, C.I. Vat Black 19, C.I. Vat Black 25 or C.I. Vat Black 27.

9. The method of claim 7, wherein the sulfur dyes used are C.I. Sulfur Black 1, C.I. Sulfur Black 6 or C.I. Sulfur Black 7.

* * * * *